US012492853B2

(12) United States Patent
Colosimo

(10) Patent No.: US 12,492,853 B2
(45) Date of Patent: Dec. 9, 2025

(54) MULTI-FUNCTION WATER COOLER

(71) Applicant: Michael Colosimo, Tucson, AZ (US)

(72) Inventor: Michael Colosimo, Tucson, AZ (US)

( * ) Notice: Subject to any disclaimer, the term of this patent is extended or adjusted under 35 U.S.C. 154(b) by 87 days.

(21) Appl. No.: 18/415,091

(22) Filed: Jan. 17, 2024

(65) Prior Publication Data

US 2025/0230964 A1 Jul. 17, 2025

(51) Int. Cl.
*F25C 5/20* (2018.01)
*F25D 23/12* (2006.01)

(52) U.S. Cl.
CPC ..... *F25C 5/24* (2018.01); *F25D 23/126* (2013.01); *F25C 2400/14* (2013.01); *F25C 2600/04* (2013.01)

(58) Field of Classification Search
CPC ..... F25D 23/126; F25C 5/24; F25C 2400/14; F25C 2600/04
See application file for complete search history.

(56) References Cited

U.S. PATENT DOCUMENTS 5,405,052 A * 4/1995 Sawyer, III ..... B67D 3/0035 222/64
5,553,744 A 9/1996 Sawyer, III
6,101,835 A 8/2000 Butsch
6,675,593 B1 1/2004 Suydam
8,083,104 B2 12/2011 Roetker
9,885,511 B2 2/2018 Brunner
10,557,742 B2 2/2020 Saville
D948,266 S 4/2022 Li
2023/0288117 A1* 9/2023 Knatt ..... F25D 29/008

FOREIGN PATENT DOCUMENTS

CA 2178749 6/1995
KR 20190118840 A * 10/2019 ..... G05D 16/2013
WO WO-2022231288 A1 * 11/2022 ..... C02F 1/68

OTHER PUBLICATIONS

English language machine translation of KR20190118840 to Yongmin et al. Translated Jun. 2025 (Year: 2019).*
English language machine translation of WO2022231288 to Jung et al. Translated Jun. 2025 (Year: 2022).*

* cited by examiner

*Primary Examiner* — Cassey D Bauer

(57) ABSTRACT

A multi-function water cooler includes an integral ice maker, a cooling arrangement, a heating arrangement, a dispensing arrangement at a variety of temperatures, and an arrangement for tracking or measuring water dispensed. The multi-function water cooler permits a user to dispense ice and water from a single machine, as well as select and set different water temperatures to be dispensed from one nozzle.

13 Claims, 7 Drawing Sheets

MULTI-FUNCTION WATER COOLER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to water coolers and more particularly pertains to a new multi-function water cooler for combining multiple functions of dispensing cold, hot, and room temperature as well as ice all in one single machine that includes a computer control for easy operation.

(2) Description of Related Art Including Information Disclosed Under 37 CFR 1.97 and 1.98

The prior art relates to water coolers. The prior art, as best understood, does not disclose a multi-function water cooler having an integral ice maker, a cooling arrangement, a heating arrangement, a dispensing arrangement at a variety of temperatures, and an arrangement for tracking or measuring water dispensed.

BRIEF SUMMARY OF THE INVENTION

An embodiment of the disclosure meets the needs presented above in a multi-function water cooler generally comprising a housing, a water dispensing arrangement, a cold water arrangement, a hot water arrangement, an ice maker and dispenser arrangement, a room temperature water arrangement, a water monitoring and control system, a water dispensing control system, an ice level sensor, a computer processor, and a user control and display arrangement. The housing includes a recessed front portion includes a top wall, a back wall, and a bottom wall. The bottom wall includes a dispensing shelf designed to permit a user to place cups or containers thereon. The water dispensing arrangement is mounted at the back wall and designed to dispense water into cups or containers. The cold water arrangement is positioned in the housing and designed to cool and conduct cold water to the water dispensing arrangement. The hot water arrangement is positioned in the housing and designed to heat and conduct hot water to the water dispensing arrangement. The ice maker and dispenser arrangement is designed to make and dispense ice into cups or containers. The ice maker and dispenser arrangement includes: a freezer unit designed to make ice, an ice reservoir positioned in an upper portion of the housing and designed to store ice, an ice dispenser mounted at the top wall to dispense ice into cups or containers, and an ice chute connecting the ice reservoir to the ice dispenser. The room temperature water arrangement is positioned in the housing and includes a water supply at room temperature and designed to conduct water to: the cold water arrangement to be cooled, the hot water arrangement to be heated, the water dispensing arrangement to be dispensed at room temperature, and the ice maker and dispenser arrangement to be made into ice. The water monitoring and control system includes level sensors, flow sensors, and temperature sensors operatively connected to each of the cold water arrangement, the hot water arrangement, and the room temperature water arrangement. The water dispensing control system is operatively connected to the water dispensing arrangement and designed to control flow of water thereto. The ice level sensor is operatively connected to the ice maker and dispenser arrangement. The computer processor is operatively connected to: the water monitoring and control system to monitor and control water levels, water flow, and water temperature in each of the cold water arrangement, the hot water arrangement, and the room temperature water arrangement; and the water dispensing control system to monitor and control flow of water to the water dispensing arrangement; and the ice level sensor and the ice maker and dispenser arrangement to monitor and control making of ice. The user control and display arrangement includes manual controls and a digital display screen positioned in a front wall of the housing above the recessed front portion and designed to permit a user to monitor the volume and type of water dispensed over a time period and set and select at least the temperature of water to be dispensed into a cup or container. In accordance with at least one possible embodiment, the manual controls comprise buttons and/or a touch screen.

In accordance with at least one possible embodiment, the multi-function water cooler is designed to permit a user to dispense ice and water from a single machine, as well as select and set different water temperatures to be dispensed from one nozzle. The user can operate the multi-function water cooler like a traditional water cooler or ice machine by activating and dispensing water or ice, whether using the manual controls, the automatic functions, or a combination of the two. However, the user can also select via the user control and display arrangement hot water, cold water, or room temperature water to be dispensed from the dispensing nozzle. In addition, the user can adjust via the user control and display arrangement the temperature of the hot water, the cold water, or the room temperature water. In other words, the user could set the cold water at a higher or lower temperature within a "cold" range of temperatures, the hot water at a higher or lower temperature within a "hot" range of temperatures, or the room temperature water at a higher or lower temperature within a "room temperature" range of temperatures.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
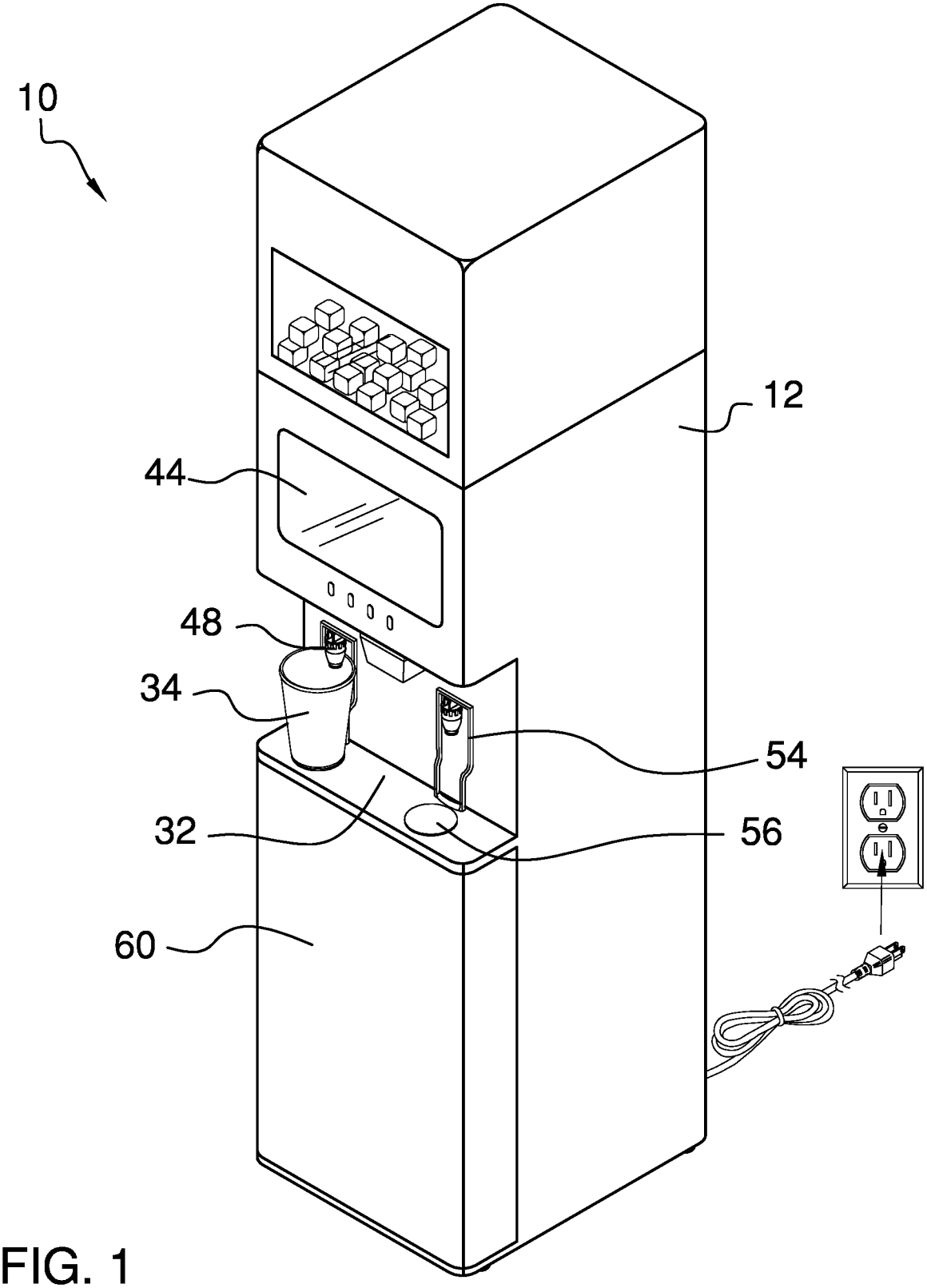
FIG. 1 is a perspective view of a multi-function water cooler according to an embodiment of the disclosure.
Figure 2:
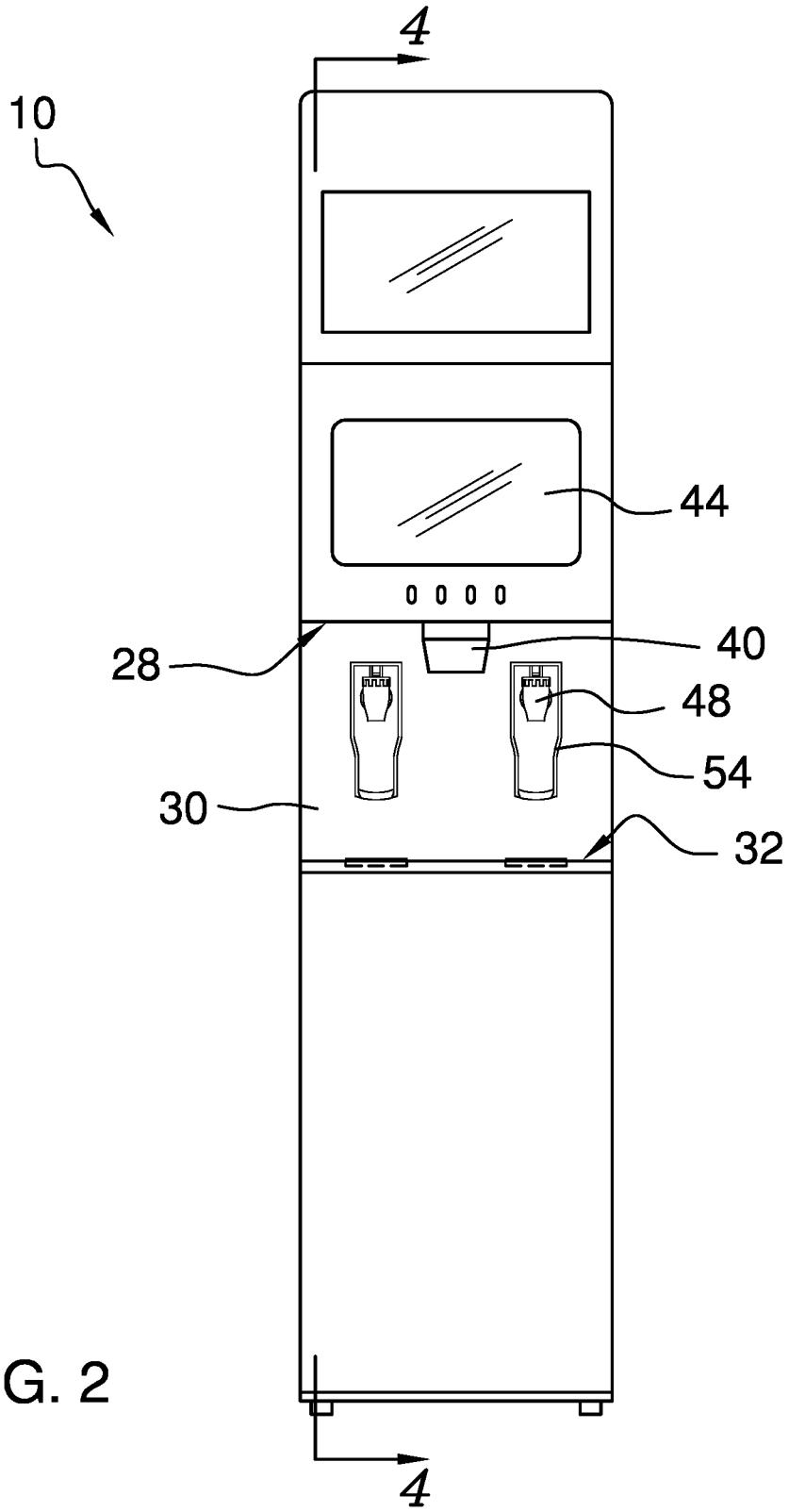
FIG. 2 is a front view of an embodiment of the disclosure.
Figure 3:
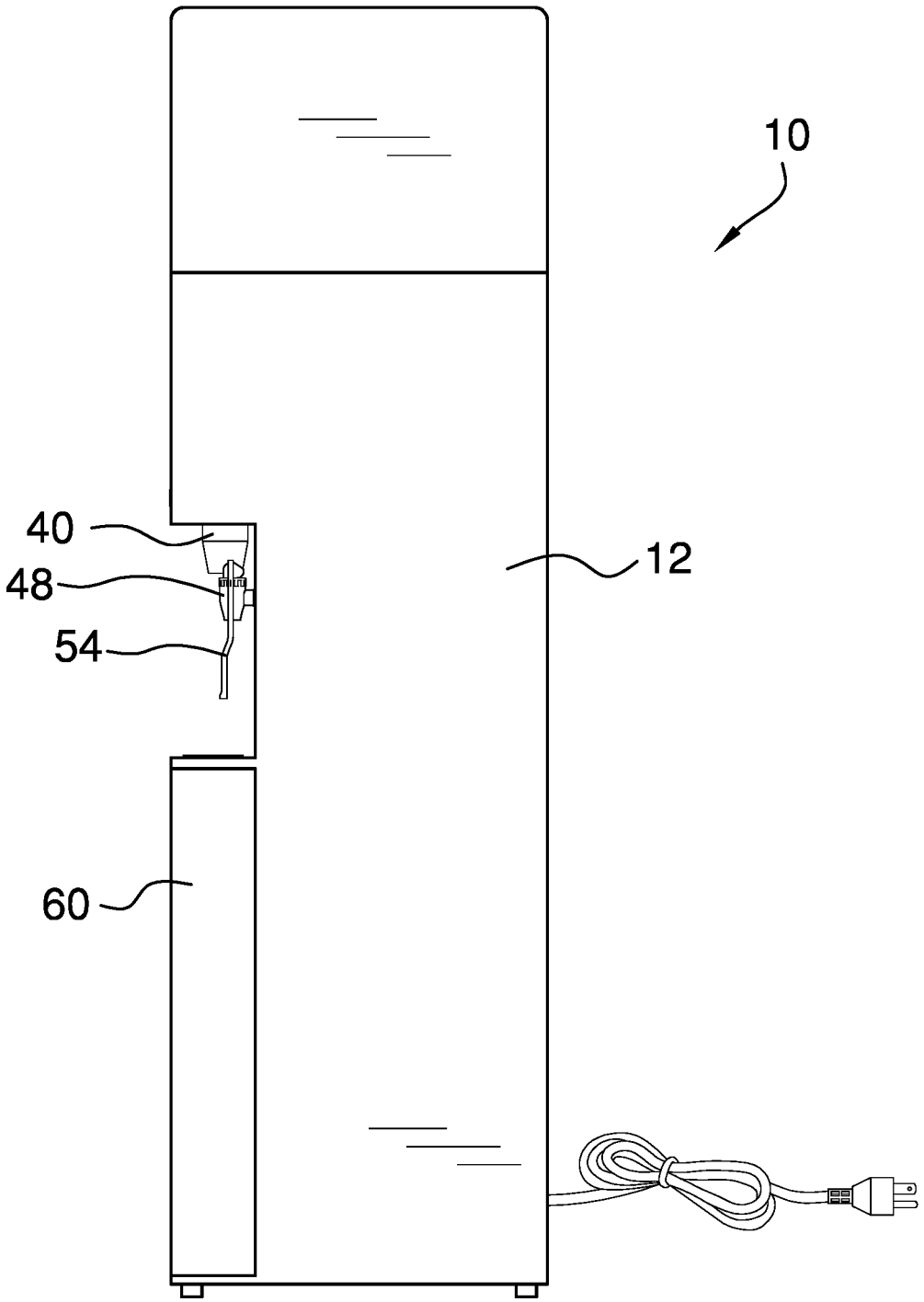
FIG. 3 is a side view of an embodiment of the disclosure.

With reference now to the drawings, and in particular to FIGS. 1 through 7 thereof, a new multi-function water cooler embodying the principles and concepts of an embodiment of the disclosure and generally designated by the reference numeral 10 will be described.

As best illustrated in FIGS. 1 through 7, the multi-function water cooler 10 generally comprises a housing 12, a water dispensing arrangement 14, a cold water arrangement 16, a hot water arrangement 18, an ice maker and dispenser arrangement 20, a room temperature water arrangement 22, a water monitoring and control system, a water dispensing control system, an ice level sensor 24, a computer processor 42, and a user control and display arrangement 26. The housing 12 includes a recessed front portion that includes a top wall, a back wall 30, and a bottom wall 32. The bottom wall 32 acts as a dispensing shelf with cup supports 56, which can be rubber or of a gripping material, designed to permit a user to place cups 34 or containers thereon. The water dispensing arrangement 14 is mounted at the back wall 30 and designed to dispense water into cup 34 or containers. The cold water arrangement 16 is positioned in the housing 12 and designed to cool and conduct cold water to the water dispensing arrangement 14. The hot water arrangement 18 is positioned in the housing 12 and designed to heat and conduct hot water to the water dispensing arrangement 14. The ice maker and dispenser arrangement 20 is designed to make and dispense ice into cup 34 or containers. The ice maker and dispenser arrangement 20 includes: a freezer unit 36 designed to make ice, an ice reservoir 38 positioned in an upper portion of the housing 12 and designed to store ice, an ice dispenser 40 mounted at the top wall to dispense ice into cup 34 or containers, and an ice chute 70 connecting the ice reservoir 38 to the ice dispenser 40. The room temperature water arrangement 22 is positioned in the housing 12 and includes a water supply at room temperature and designed to conduct water to: the cold water arrangement 16 to be cooled, the hot water arrangement 18 to be heated, the water dispensing arrangement 14 to be dispensed at room temperature, and the ice maker and dispenser arrangement 20 to be made into ice. The water monitoring and control system includes level sensors, flow sensors, and temperature sensors operatively connected to each of the cold water arrangement 16, the hot water arrangement 18, and the room temperature water arrangement 22. The water dispensing control system is operatively connected to the water dispensing arrangement 14 and designed to control flow of water thereto. The ice level sensor 24 is operatively connected to the ice maker and dispenser arrangement 20. The computer processor 42 is operatively connected to: the water monitoring and control system to monitor and control water levels, water flow, and water temperature in each of the cold water arrangement 16, the hot water arrangement 18, and the room temperature water arrangement 22; and the water dispensing control system to monitor and control flow of water to the water dispensing arrangement 14; and the ice level sensor 24 and the ice maker and dispenser arrangement 20 to monitor and control making of ice. The user control and display arrangement 26 includes manual controls and a digital display screen 44 positioned in a front wall of the housing 12 above the recessed front portion and designed to permit a user to monitor the volume and type of water dispensed over a time period and set and select at least the temperature of water to be dispensed into a cup 34 or container. In accordance with at least one possible embodiment, the manual controls comprise buttons 46 and/or a touch screen.

In accordance with at least one possible embodiment, the water dispensing arrangement 14 includes at least one dispensing nozzle 48 mounted on and projecting from the back wall 30. The water dispensing arrangement 14 includes a three-way valve (not shown) designed to permit the flow of cold, hot, or room temperature water to the at least one dispensing nozzle 48 as selected by a user.

In accordance with at least one possible embodiment, the room temperature water arrangement 22 includes a valve manifold 50 and a pump 52 designed to pump 52 water from the water supply and to the valve manifold 50. The cold water arrangement 16 includes a cold water tank, a cooling arrangement, and cold water pipes operatively connected to the valve manifold 50 and the water dispensing arrangement 14. The hot water arrangement 18 includes a hot water tank, a heating arrangement, and hot water pipes operatively connected to the valve manifold 50 and the water dispensing arrangement 14. The room temperature water arrangement 22 includes room temperature pipes operatively connected to the valve manifold 50 and the water dispensing arrangement 14. The ice maker and dispenser arrangement 20 includes ice maker pipes operatively connected to the valve manifold 50 and the freezer unit 36.

In accordance with at least one possible embodiment, the at least one dispensing nozzle 48 includes a nozzle valve and dispenser lever 54 connected thereto. The dispenser lever 54 is designed and positioned to be temporarily moved by a cup 34 or container to open the nozzle valve and permit water to be dispensed into the cup 34 or container.

Figure 6:
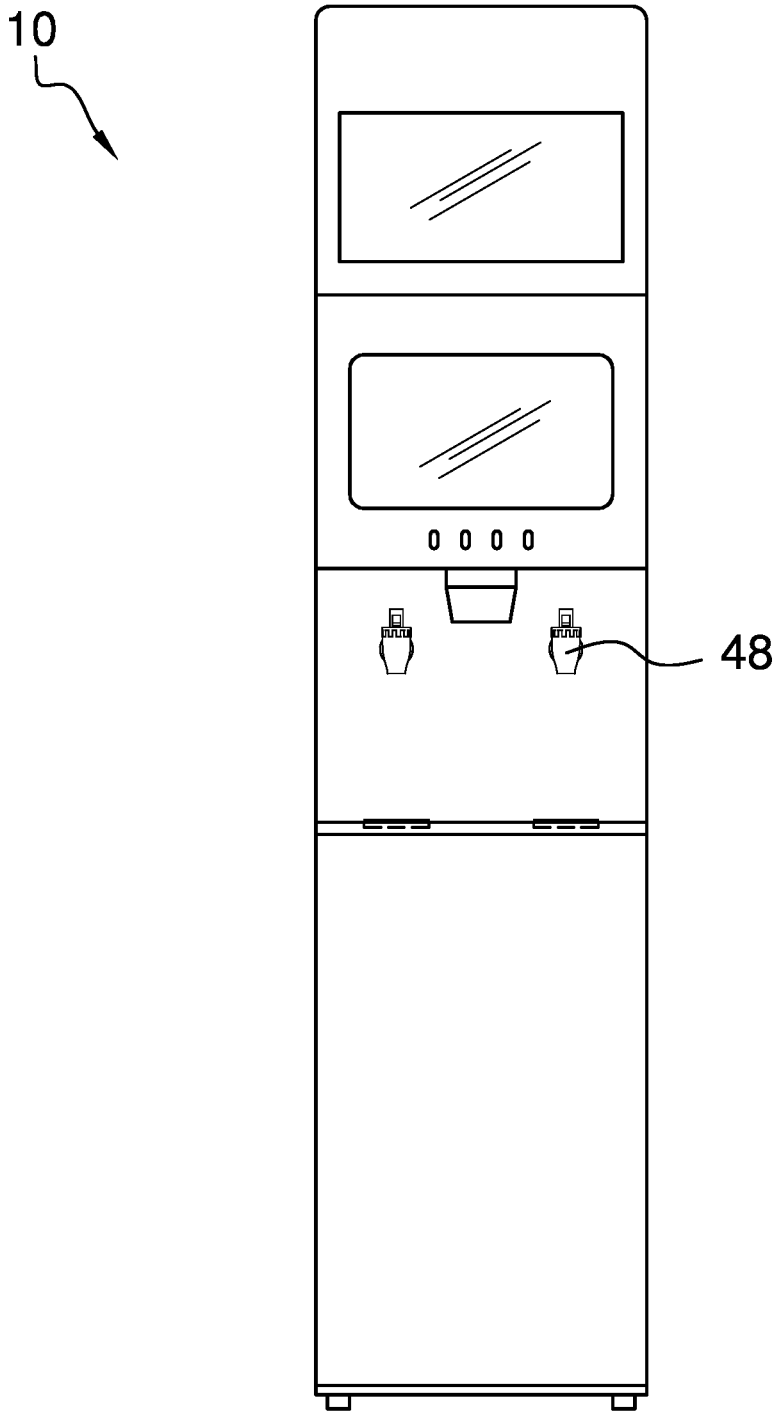
FIG. 6 is a front view of an embodiment of the disclosure.

In accordance with at least one possible embodiment, the at least one dispensing nozzle 48 includes a nozzle valve. The water monitoring and control system is designed to automatically control the opening and closing of the nozzle valve in accordance with an amount of water selected by a user, so the dispenser lever 54 may be omitted as shown in FIG. 6. In accordance with at least one possible embodiment, the water monitoring and control system includes a flow meter to detect the flow of water. In accordance with at least one other possible embodiment, the multi-function water cooler 10 further includes at least one weight sensor positioned in the cup support 56 of the dispensing shelf and designed to sense a weight of water in a cup 34 or container thereon. The at least one weight sensor is operatively connected to the water monitoring and control system. The automatic control of the nozzle valve is accomplished by using either the flow meter or the at least one weight sensor. It should be understood that the multi-function water cooler 10 can have two dispensing nozzles, such as is shown in the figures, or possibly only one or possibly more.

Figure 4:
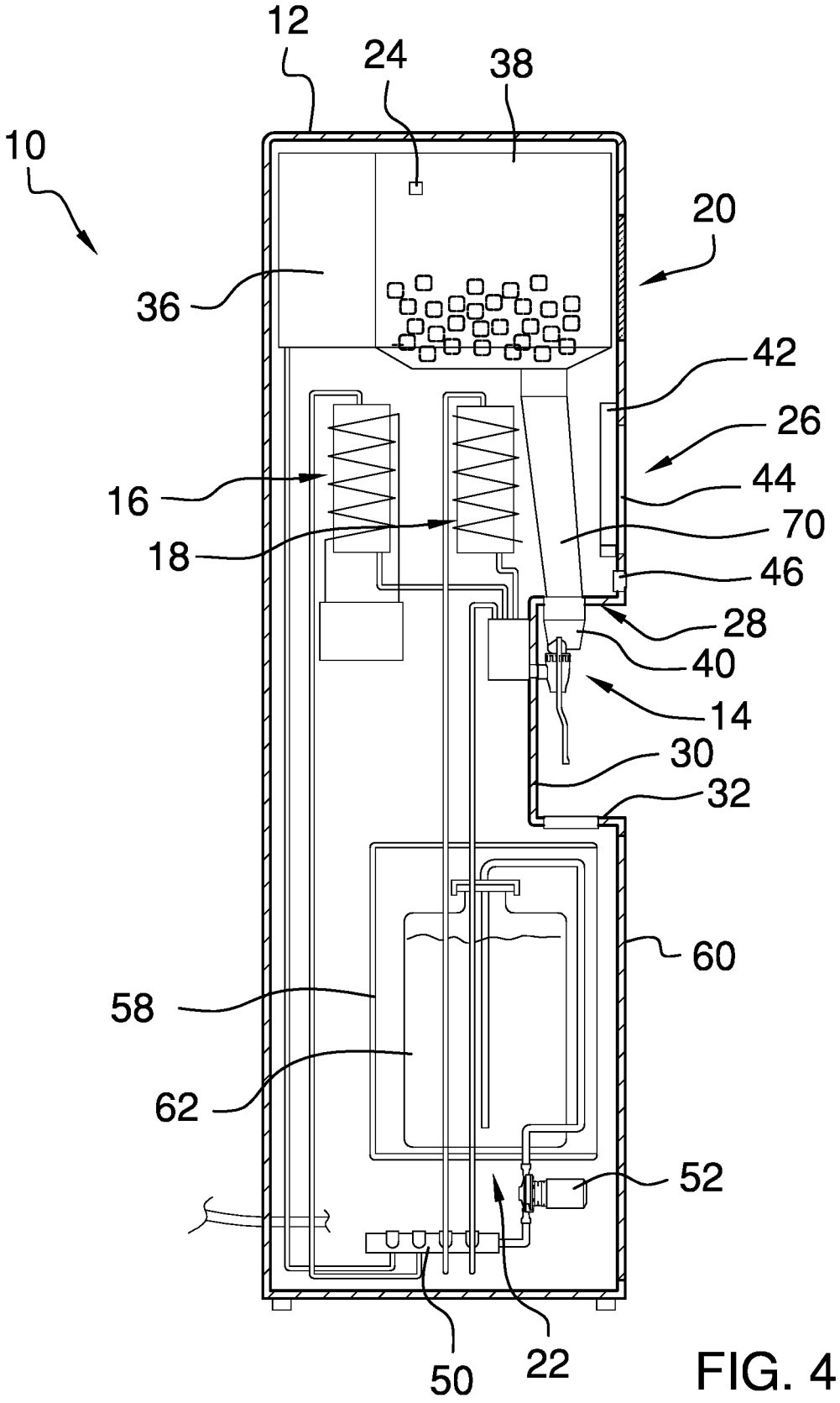
FIG. 4 is a cross-sectional view of an embodiment of the disclosure.

In accordance with at least one possible embodiment, as shown in FIG. 4, the housing 12 includes a water supply compartment 58 positioned in a lower portion of the housing 12. The housing 12 includes a water supply door 60 that is openable and closable to permit a user to access the water supply compartment 58. The water supply includes a water jug 62 that is removable and replaceable by a user.

Figure 5:
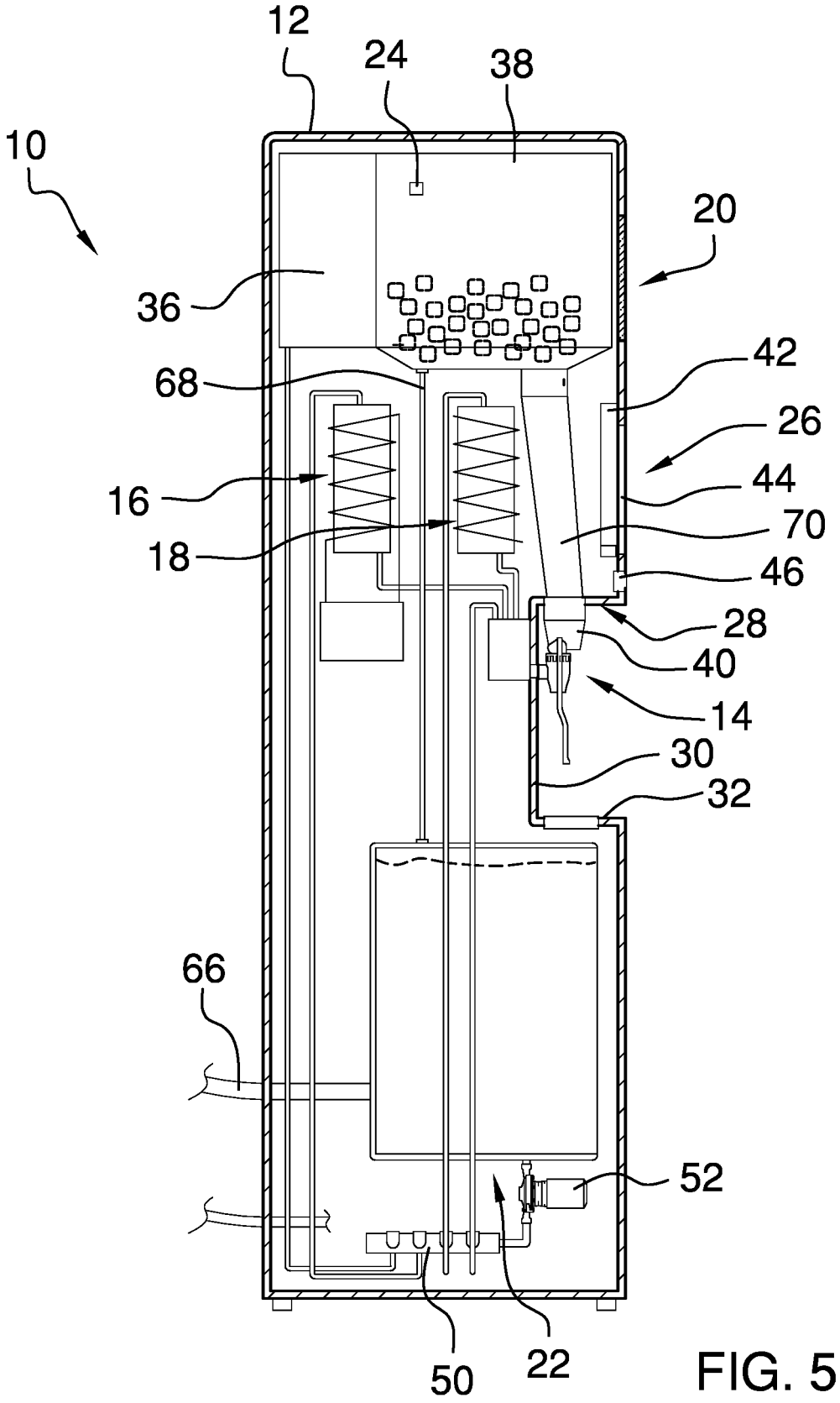
FIG. 5 is a cross-sectional view of an embodiment of the disclosure.

In accordance with at least one possible embodiment, as shown in FIG. 5, the water supply includes a tank 64 mounted in a lower portion of the housing 12 and a supply hose 66 connected to the tank 64. In accordance with at least one possible embodiment, the ice maker and dispenser arrangement 20 includes a drain pipe 68 operatively connected to the tank 64 to recycle water from melted ice.

Figure 7:
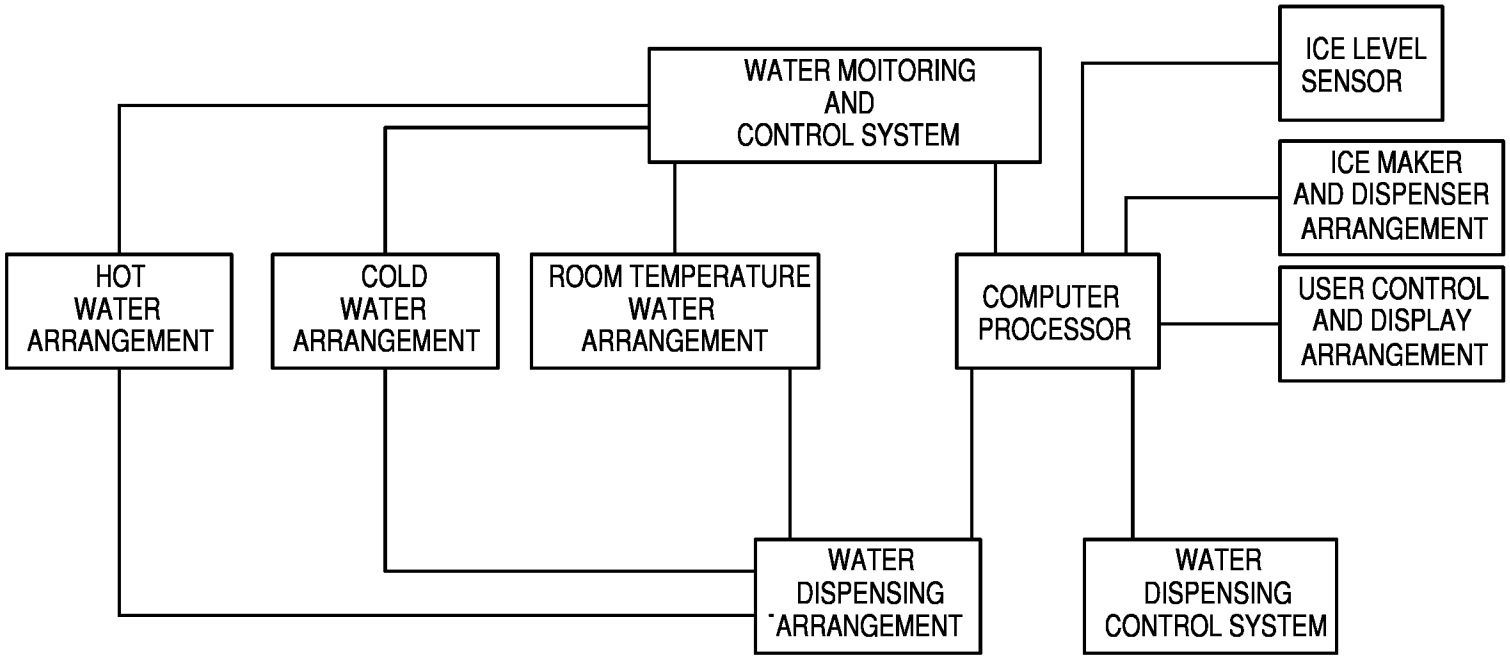
FIG. 7 is a block diagram of an embodiment of the disclosure.

FIG. 7 shows a block diagram showing how the computer processor 42 is operatively connected to all of the systems of the multi-function water cooler 10 to control the operation thereof either automatically or by input from the user, or by a combination of the two. In accordance with at least one possible embodiment, the computer processor 42 is designed to receive and store operating data relating to: the amount of water in each of the hot water tank, the cold water tank, and the water supply, the amount of ice in the ice reservoir 38, and the amount and type of water dispensed over a time period. The user control and display arrangement 26 is designed to display stored operating data on the digital display screen 44 for viewing by a user.

In accordance with at least one possible embodiment, the multi-function water cooler 10 is designed to permit a user to dispense ice and water from a single machine, as well as select and set different water temperatures to be dispensed from one nozzle. The user can operate the multi-function water cooler 10 like a traditional water cooler or ice machine by activating and dispensing water or ice, whether using the manual controls, the automatic functions, or a combination of the two. However, the user can also select via the user control and display arrangement 26 hot water, cold water, or room temperature water to be dispensed from the dispensing nozzle 48. In addition, the user can adjust via the user control and display arrangement 26 the temperature of the hot water, the cold water, or the room temperature water. In other words, the user could set the cold water at a higher or lower temperature within a "cold" range of temperatures, the hot water at a higher or lower temperature within a "hot" range of temperatures, or the room temperature water at a higher or lower temperature within a "room temperature" range of temperatures.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multi-function water cooler comprising:

a housing comprising a recessed front portion comprising a top wall, a back wall, and a bottom wall;

said bottom wall comprising a dispensing shelf configured to permit a user to place cups or containers thereon;

a water dispensing arrangement mounted at said back wall and configured to dispense water into cups or containers;

a cold water arrangement disposed in said housing and configured to cool and conduct cold water to said water dispensing arrangement;

a hot water arrangement disposed in said housing and configured to heat and conduct hot water to said water dispensing arrangement;

an ice maker and dispenser arrangement configured to make and dispense ice into cups or containers;

said ice maker and dispenser arrangement comprising:

a freezer unit configured to make ice, an ice reservoir disposed in an upper portion of said housing and configured to store ice, an ice dispenser mounted at said top wall to dispense ice into cups or containers, and an ice chute connecting said ice reservoir to said ice dispenser;

a room temperature water arrangement disposed in said housing and comprising a water supply at room temperature and configured to conduct water to:

said cold water arrangement to be cooled, said hot water arrangement to be heated, said water dispensing arrangement to be dispensed at room temperature, and said ice maker and dispenser arrangement to be made into ice;

a water monitoring and control system comprising level sensors, flow sensors, and temperature sensors operatively connected to each of said cold water arrangement, said hot water arrangement, and said room temperature water arrangement;

a water dispensing control system operatively connected to said water dispensing arrangement and configured to control flow of water to the water dispensing arrangement;

an ice level sensor operatively connected to said ice maker and dispenser arrangement;

a computer processor operatively connected to:

said water monitoring and control system to monitor and control water levels, water flow, and water temperature in each of said cold water arrangement, said hot water arrangement, and said room temperature water arrangement;

said water dispensing control system to monitor and control flow of water to said water dispensing arrangement;

said ice level sensor and said ice maker and dispenser arrangement to monitor and control making of ice; and a user control and display arrangement comprising manual controls and a digital display screen disposed in a front wall of said housing above said recessed front portion and configured to permit a user to monitor the volume and type of water dispensed over a time period and set and select at least the temperature of water to be dispensed into a cup or container.

2. The multi-function water cooler of claim 1, wherein:

said water dispensing arrangement comprises at least one dispensing nozzle mounted on and projecting from said back wall; and said water dispensing arrangement comprises a three-way valve configured to permit the flow of cold, hot, or room temperature water to said at least one dispensing nozzle as selected by a user.

3. The multi-function water cooler of claim 2, wherein:

said room temperature water arrangement comprises a valve manifold and a pump configured to pump water from said water supply and to said valve manifold;

said cold water arrangement comprises a cold water tank, a cooling arrangement, and cold water pipes operatively connected to said valve manifold and said water dispensing arrangement;

said hot water arrangement comprises a hot water tank, a heating arrangement, and hot water pipes operatively connected to said valve manifold and said water dispensing arrangement;

said room temperature water arrangement comprises room temperature pipes operatively connected to said valve manifold and said water dispensing arrangement; and said ice maker and dispenser arrangement comprises ice maker pipes operatively connected to said valve manifold and said freezer unit.

4. The multi-function water cooler of claim 3, wherein:

said at least one dispensing nozzle comprises a nozzle valve and dispenser lever connected thereto; and said dispenser lever is configured and disposed to be temporarily moved by a cup or container to open said nozzle valve and permit water to be dispensed into the cup or container.

5. The multi-function water cooler of claim 3, wherein:

said at least one dispensing nozzle comprises a nozzle valve;

said water monitoring and control system is configured to automatically control the opening and closing of said nozzle valve in accordance with an amount of water selected by a user; and one of (A) and (B):

(A) said water monitoring and control system comprises a flow meter to detect the flow of water; and (B) the multi-function water cooler further comprises at least one weight sensor disposed in said dispensing shelf and configured to sense a weight of water in a cup or container thereon; and said at least one weight sensor is operatively connected to said water monitoring and control system.

6. The multi-function water cooler of claim 3, wherein:

said housing comprises a water supply compartment disposed in a lower portion of said housing;

said housing comprises a water supply door that is openable and closable to permit a user to access said water supply compartment; and said water supply comprises a water jug that is removable and replaceable by a user.

7. The multi-function water cooler of claim 3, wherein said water supply comprises a water supply tank mounted in a lower portion of said housing and a supply hose connected to said water supply tank.

8. The multi-function water cooler of claim 7, wherein said ice maker and dispenser arrangement comprises a drain pipe operatively connected to said water supply tank to recycle water from melted ice.

9. The multi-function water cooler of claim 3, wherein:

said computer processor is configured to receive and store operating data relating to:

the amount of water in each of said hot water tank, said cold water tank, and said water supply, the amount of ice in said ice reservoir, and the amount and type of water dispensed over a time period;

said user control and display arrangement is configured to display stored operating data on said digital display screen for viewing by a user.

10. The multi-function water cooler of claim 3, wherein said manual controls comprise buttons and/or a touch screen.

11. The multi-function water cooler of claim 3, wherein:

said at least one dispensing nozzle comprises a nozzle valve and dispenser lever connected thereto;

said dispenser lever is configured and disposed to be temporarily moved by a cup or container to open said nozzle valve and permit water to be dispensed into the cup or container;

said water supply comprises a water supply tank mounted in a lower portion of said housing and a supply hose connected to said water supply tank;

said ice maker and dispenser arrangement comprises a drain pipe operatively connected to said tank to recycle water from melted ice;

said computer processor is configured to receive and store operating data relating to:

the amount of water in each of said hot water tank, said cold water tank, and said water supply tank, the amount of ice in said ice reservoir, and the amount and type of water dispensed over a time period;

said user control and display arrangement is configured to display stored operating data on said digital display screen for viewing by a user; and said manual controls comprise buttons and/or a touch screen.

12. The multi-function water cooler of claim 3, wherein:

said at least one dispensing nozzle comprises a nozzle valve;

said water monitoring and control system is configured to automatically control the opening and closing of said nozzle valve in accordance with an amount of water selected by a user;

the multi-function water cooler further comprises at least one weight sensor disposed in said dispensing shelf and configured to sense a weight of water in a cup or container thereon; and said at least one weight sensor is operatively connected to said water monitoring and control system.

13. A method of using the multi-function water cooler of claim 1, comprising:

selecting via said user control and display arrangement hot water, cold water, or room temperature water to be dispensed;

adjusting via said user control and display arrangement the temperature of the hot water, the cold water, or the room temperature water; and dispensing the selected water into a cup or container.

* * * * *